US011421371B2

(12) United States Patent
Kwon et al.

(10) Patent No.: US 11,421,371 B2
(45) Date of Patent: Aug. 23, 2022

(54) LAUNDRY TREATING APPARATUS

(71) Applicant: LG ELECTRONICS INC., Seoul (KR)

(72) Inventors: Yongwoo Kwon, Seoul (KR); Jungsang You, Seoul (KR); Donghyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 213 days.

(21) Appl. No.: 16/776,639

(22) Filed: Jan. 30, 2020

(65) Prior Publication Data

US 2020/0248389 A1 Aug. 6, 2020

(30) Foreign Application Priority Data

Feb. 1, 2019 (KR) ..... 10-2019-0014064
May 17, 2019 (KR) ..... 10-2019-0058238
Oct. 14, 2019 (KR) ..... 10-2019-0127330

(51) Int. Cl.
*D06F 39/14* (2006.01)
*E05B 65/00* (2006.01)

(52) U.S. Cl.
CPC ..... *D06F 39/14* (2013.01); *E05B 65/006* (2013.01); *E05Y 2900/312* (2013.01)

(58) Field of Classification Search
CPC ... D06F 39/14; E05B 65/006; E05Y 2900/312
USPC ..... 68/12.26
See application file for complete search history.

(56) References Cited

U.S. PATENT DOCUMENTS 6,256,823 B1 7/2001 Kronbetter et al.
8,148,633 B2 4/2012 Hung
8,555,681 B2 10/2013 Caudevilla De Sola et al.
8,570,737 B2 10/2013 Rayner
2004/0177656 A1 9/2004 Kwon
(Continued)

FOREIGN PATENT DOCUMENTS

CN 1475621 2/2004
CN 1607290 4/2005
(Continued)

OTHER PUBLICATIONS

CN208293271U—machine translation (Year: 2018).*
(Continued)

*Primary Examiner* — Tinsae B Ayalew
(74) *Attorney, Agent, or Firm* — Ked & Associates LLP

(57) ABSTRACT

A laundry treating apparatus may include a main body having a front panel having a laundry inlet port through which laundry may be loaded, and a door rotatably coupled to the front panel to open and close the laundry inlet port. The door may include an outer frame provided with an opening and facing an outside of the main body; a front glass coupled to a front surface of the outer frame to cover the opening; an inner frame coupled to a rear surface of the outer frame and facing an inside of the main body; a handle provided at a rear surface of the inner frame in a direction opposite to the front glass to receive a user's hand to pull the door while the door is closed; a hook that protrudes from an outer circumference of the outer frame to cover a side surface of the handle; and a hook coupling portion that protrudes from the side surface of the inner frame to engage with the hook.

28 Claims, 7 Drawing Sheets

(56) References Cited

U.S. PATENT DOCUMENTS

| | | | |
|---|---|---|---|
| 2005/0034486 | A1 | 2/2005 | Bienick et al. |
| 2005/0138974 | A1 | 6/2005 | Ha et al. |
| 2005/0262681 | A1 | 12/2005 | Yoon |
| 2006/0117813 | A1 | 6/2006 | Ha et al. |
| 2006/0218975 | A1 | 10/2006 | Graute et al. |
| 2007/0051012 | A1 | 3/2007 | Schoene |
| 2007/0125132 | A1 | 6/2007 | Hwang |
| 2007/0137261 | A1 | 6/2007 | Kwon |
| 2007/0240456 | A1 | 10/2007 | Byun et al. |
| 2008/0223085 | A1 | 9/2008 | Park |
| 2008/0302141 | A1 | 12/2008 | Chung |
| 2009/0165391 | A1 | 7/2009 | Kocak et al. |
| 2011/0025178 | A1 | 2/2011 | Schöne |
| 2011/0050059 | A1 | 3/2011 | Kim et al. |
| 2015/0000200 | A1 | 1/2015 | Kim et al. |
| 2015/0003027 | A1 | 1/2015 | Han et al. |
| 2016/0369445 | A1 | 12/2016 | Kim et al. |
| 2017/0121884 | A1 | 5/2017 | Kwon et al. |
| 2017/0121889 | A1 | 5/2017 | Kwon et al. |
| 2017/0121890 | A1 | 5/2017 | Kwon et al. |
| 2017/0167070 | A1 | 6/2017 | Khamprachom et al. |
| 2017/0183803 | A1 | 6/2017 | Kim et al. |
| 2017/0260678 | A1 | 9/2017 | Wee et al. |
| 2018/0002853 | A1 | 1/2018 | Anand et al. |
| 2018/0163333 | A1 | 6/2018 | Zhang et al. |
| 2018/0195226 | A1 | 7/2018 | Kwon et al. |
| 2018/0216282 | A1 | 8/2018 | Lee et al. |
| 2018/0274155 | A1 | 9/2018 | Anand et al. |
| 2018/0363198 | A1 | 12/2018 | Gim |
| 2019/0071815 | A1 | 3/2019 | Woodham, Jr. et al. |

FOREIGN PATENT DOCUMENTS

| | | | | |
|---|---|---|---|---|
| CN | 1880559 | | 12/2006 | |
| CN | 1940167 | | 4/2007 | |
| CN | 101074531 | | 11/2007 | |
| CN | 101671930 | | 3/2010 | |
| CN | 104372569 | | 2/2015 | |
| CN | 104420137 | | 3/2015 | |
| CN | 204311247 | | 5/2015 | |
| CN | 104975466 | | 10/2015 | |
| CN | 204780322 | | 11/2015 | |
| CN | 105937137 | | 9/2016 | |
| CN | 106012423 | | 10/2016 | |
| CN | 106032611 | | 10/2016 | |
| CN | 106133231 | | 11/2016 | |
| CN | 205907515 | | 1/2017 | |
| CN | 107287850 | | 10/2017 | |
| CN | 107541888 | | 1/2018 | |
| CN | 107641942 | | 1/2018 | |
| CN | 107974810 | | 5/2018 | |
| CN | 108796966 | | 11/2018 | |
| CN | 208293271 | | 12/2018 | |
| CN | 109112795 | | 1/2019 | |
| DE | 29721320 | | 2/1998 | |
| DE | 20 2012 101253 | | 4/2013 | |
| DE | 20 2014 010 568 | | 2/2016 | |
| EP | 0 870 861 | | 10/1998 | |
| EP | 1262 589 | | 12/2002 | |
| EP | 1522 623 | | 4/2005 | |
| EP | 1 309 749 | | 12/2005 | |
| EP | 1 860 228 | | 11/2007 | |
| EP | 2 147 996 | | 1/2010 | |
| EP | 2 161 364 | | 3/2010 | |
| EP | 2 677 076 | | 12/2013 | |
| EP | 2740833 | A1 * | 6/2014 | ..... D06F 58/20 |
| EP | 3 112 524 | | 1/2017 | |
| EP | 2 740 833 | | 4/2017 | |
| EP | 3 162 945 | | 5/2017 | |
| EP | 3 181 750 | | 6/2017 | |
| EP | 3 332 060 | | 6/2018 | |
| EP | 3 363 945 | | 8/2018 | |
| EP | 3 875 670 | | 9/2021 | |
| FR | 2691298 | | 11/1993 | |
| FR | 2 733 258 | | 10/1996 | |
| FR | 2756575 | | 6/1998 | |
| GB | 2118580 | | 11/1983 | |
| GB | 2320507 | | 6/1998 | |
| GB | 2320507 | A * | 6/1998 | ..... D06F 39/14 |
| IT | VR20120061 | | 9/2017 | |
| JP | H06-31766 | | 4/1994 | |
| JP | H10-24130 | | 1/1998 | |
| JP | 2000-145022 | | 5/2000 | |
| JP | 2005-058771 | | 3/2005 | |
| JP | 2005-160952 | | 6/2005 | |
| JP | 2008-295957 | | 12/2008 | |
| JP | 2010-063522 | | 3/2010 | |
| JP | 2012-075689 | | 4/2012 | |
| JP | 2012-223344 | | 11/2012 | |
| JP | 2014-003293 | | 1/2014 | |
| JP | 2014-151948 | | 8/2014 | |
| JP | 2016-049112 | | 4/2016 | |
| JP | 2017-038828 | | 2/2017 | |
| JP | 2017-099993 | | 6/2017 | |
| JP | 2018-514346 | | 6/2018 | |
| JP | 2018-110645 | | 7/2018 | |
| JP | 2018-531753 | | 11/2018 | |
| JP | 2018-532545 | | 11/2018 | |
| JP | 2018-536517 | | 12/2018 | |
| KR | 10-2004-0011219 | | 2/2004 | |
| KR | 10-0465148 | | 1/2005 | |
| KR | 2005-0021057 | | 3/2005 | |
| KR | 20050021057 | A * | 3/2005 | |
| KR | 10-0595180 | | 6/2006 | |
| KR | 10-2007-0002458 | | 1/2007 | |
| KR | 10-2007-0044599 | | 4/2007 | |
| KR | 10-2007-0070780 | | 7/2007 | |
| KR | 10-2010-0019091 | | 2/2010 | |
| KR | 10-2010-0042984 | | 4/2010 | |
| KR | 10-2011-0013011 | | 2/2011 | |
| KR | 10-2011-0028899 | | 3/2011 | |
| KR | 10-1138697 | | 6/2012 | |
| KR | 10-1156707 | | 6/2012 | |
| KR | 10-2014-0006647 | | 1/2014 | |
| KR | 10-2015-0003592 | | 1/2015 | |
| KR | 10-2015-0006264 | | 1/2015 | |
| KR | 10-2016-0041886 | | 4/2016 | |
| KR | 10-1708350 | | 2/2017 | |
| KR | 10-1708351 | | 2/2017 | |
| KR | 10-1708352 | | 2/2017 | |
| KR | 10-1708355 | | 2/2017 | |
| KR | 10-2018-0089992 | | 8/2018 | |
| KR | 10-2018-0136086 | | 12/2018 | |
| KR | 10-2018-0136094 | | 12/2018 | |
| KR | 10-2018-0136095 | | 12/2018 | |
| KR | 10-2018-0136102 | | 12/2018 | |
| RU | 2355836 | | 5/2009 | |
| WO | WO 2015/144236 | | 10/2015 | |
| WO | WO 2017/020959 | | 2/2017 | |
| WO | WO 2018/001160 | | 1/2018 | |
| WO | WO 2018/077130 | | 5/2018 | |
| WO | WO 2018/121942 | | 7/2018 | |
| WO | WO 2018/138946 | | 8/2018 | |

OTHER PUBLICATIONS

KR20050021057A—machine translation (Year: 2005).*

Japanese Office Action dated Dec. 15, 2020 issued in JP Application No. JP 2020-013134.

Japanese Office Action dated Dec. 15, 2020 issued in JP Application No. JP 2020-013137.

Japanese Office Action dated Feb. 2, 2021 issued in JP Application No. JP 2020-013079.

Australian Examination Report dated Aug. 17, 2020 issued in Application No. 2020200534.

Korean Office Action dated Jun. 15, 2021 issued in KR Application No. 10-2019-0124785.

Australian Office Action dated Sep. 17, 2020 issued in AU Application No. 2020200522.

Japanese Office Action dated Mar. 2, 2021 issued in JP Application No. 2020-013080.

Australian Office Action dated Apr. 1, 2021 issued in AU Application No. 2020200550.

(56) References Cited

OTHER PUBLICATIONS

International Search Report dated May 18, 2020 issued in PCT Application No. PCT/KR2020/001531.
Korean Office Action dated Jun. 15, 2021 issued in KR Application No. 10-2019-0127328.
Korean Office Action dated Jun. 15, 2021 issued in KR Application No. 10-2019-0127330.
Korean Office Action dated Jun. 15, 2021 issued in KR Application No. 10-2019-0127998.
Korean Office Action dated Jun. 15, 2021 issued in KR Application No. 10-2020-0011873.
European Search Report dated Jun. 24, 2020 issued in EP Application No. 20152188.7.
European Search Report dated Jun. 24, 2020 issued in EP Application No. 20152181.2.
European Search Report dated Jun. 24, 2020 issued in EP Application No. 20152156.4.
European Search Report dated Jul. 1, 2020 issued in EP Application No. 20152169.7.
European Search Report dated Jul. 7, 2020 issued in EP Application No. 20152158.0.
Korean Office Action dated Jul. 23, 2020 issued in KR Application No. 10-2019-0058241.
Russian Notice of Allowance dated Aug. 25, 2020 issued in RU Application No. 2020103247.
Australian Office Action dated Sep. 2, 2020 issued in AU Application No. 2020200550.
European Search Report dated Jun. 29, 2020 issued in Application No. 20152175.4.
Korean Office Action dated Jun. 15, 2021 issued in KR Application No. 10-2019-0058251.
Korean Office Action dated Jun. 15, 2021 issued in KR Application No. 10-2019-0060211.
Japanese Office Action dated Feb. 2, 2021 issued in JP Application No. 2020-012212.
Russian Office Action issued in Application No. 2020200539 dated Jun. 11, 2020.
European Search Report issued in Application No. 20152173.9 dated Jul. 1, 2020.
Australian Office Action issued in Application No. 2020102680/03 dated Aug. 17, 2020.
Russian Notice of Allowance dated Apr. 21, 2020 issued in RU Application No. 2020103239.
Russian Notice of Allowance dated May 15, 2020 issued in RU Application No. 2020103240.
Russian Office Action dated Jun. 18, 2020 issued in RU Application No. 2020103247.
Russian Notice of Allowance dated May 25, 2020 issued in RU Application No. 2020102678.
European Search Report dated Jul. 1, 2020 issued in EP Application No. 20152172.1.
United States Office Action dated Mar. 2, 2022 issued in co-pending related U.S. Appl. No. 16/776,779.
U.S. Office Action dated Dec. 15, 2021 issued in U.S. Appl. No. 16/776,820.
U.S. Appl. No. 16/776,624, filed Jan. 30, 2020.
U.S. Appl. No. 16/776,639, filed Jan. 30, 2020.
U.S. Appl. No. 16/776,683, filed Jan. 30, 2020.
U.S. Appl. No. 16/776,695, filed Jan. 30, 2020.
U.S. Appl. No. 16/776,739, filed Jan. 30, 2020.
U.S. Appl. No. 16/776,780, filed Jan. 30, 2020.
U.S. Appl. No. 16/776,779, filed Jan. 30, 2020.
U.S. Appl. No. 16/776,820, filed Jan. 30, 2020.
United States Office Action dated Jan. 14, 2022 issued in co-pending related U.S. Appl. No. 16/776,695.
United States Office Action dated Jan. 24, 2022 issued in co-pending related U.S. Appl. No. 16/776,739.
Chinese Office Action dated Mar. 3, 2022 issued in CN Application No. 201911291955.6.
Chinese Office Action dated Mar. 4, 2022 issued in CN Application No. 201911338352.7.
Chinese Office Action dated Mar. 8, 2022 issued in CN Application No. 201911356949.4.
Chinese Office Action dated Mar. 17, 2022 issued in CN Application No. 201911338904.4.
Chinese Office Action dated Mar. 21, 2022 issued in CN Application No. 201911265766.1.
Chinese Office Action dated Apr. 2, 2022 issued in CN Application No. 201911356952.6.
German Office Action dated Apr. 8, 2022 issued in DE Application No. 102020100945.3.
Chinese Office Action issued in Application No. 201911356954.5 dated May 7, 2022.
U.S. Office Action issued in U.S. Appl. No. 16/776,780 dated May 24, 2022.

* cited by examiner

LAUNDRY TREATING APPARATUS

CROSS-REFERENCE TO RELATED APPLICATION(S)

Pursuant to 35 U.S.C. § 119(a), this application claims the benefit of an earlier filing date of and the right of priority to Korean Patent Applications No. 10-2019-0014064, filed in Korea on Feb. 1, 2019, No. 10-2019-0058238, filed in Korea on May 17, 2019 and No. 10-2019-0127330, filed in Korea on Oct. 14, 2019, the contents of which are incorporated by reference herein in its entirety.

BACKGROUND

1. Field

A laundry treating apparatus having a hook fastening structure of a handle provided in a door to pull the door is disclosed herein.

2. Background

In general, a laundry treating apparatus may include an apparatus having a function of washing or drying laundry or other items (hereinafter, collectively "laundry"). In addition, the laundry treating apparatus may be configured to have both a washing function and a drying function of the laundry.

The laundry treating apparatus may include a main body having a laundry inlet port, a door configured to open and close the laundry inlet port, and a laundry accommodating portion provided in the body. The door may include a door frame, a front glass attached to a front surface of the door frame, and a door window mounted on the door frame to protrude through the laundry input port. The door frame may include an outer frame disposed toward an outside of the main body, and an inner frame disposed toward an inside of the main body when the door is closed.

On the other hand, in order to pull the door when a user opens the door, it is required to provide the handle on the door frame. However, when the front glass is bonded to a front surface of the outer frame, it is difficult to provide or attach the handle to the front glass due to characteristics of the front glass which is made of a fragile glass material.

In addition, as the front glass covers a front surface of the outer frame, and the inner frame is coupled to cover a rear surface of the outer frame, an area where the handle can be provided on the outer frame is very small, and thus, an installation position of the handle is extremely limited. Therefore, there is a need for a structure for easily providing and fastening the handle on a rear surface of the inner frame having a relatively high degree of freedom of installation.

BRIEF DESCRIPTION OF THE DRAWINGS

Embodiments will be described in detail with reference to the following drawings in which like reference numerals refer to like elements, and wherein.

DETAILED DESCRIPTION

Figure 1:
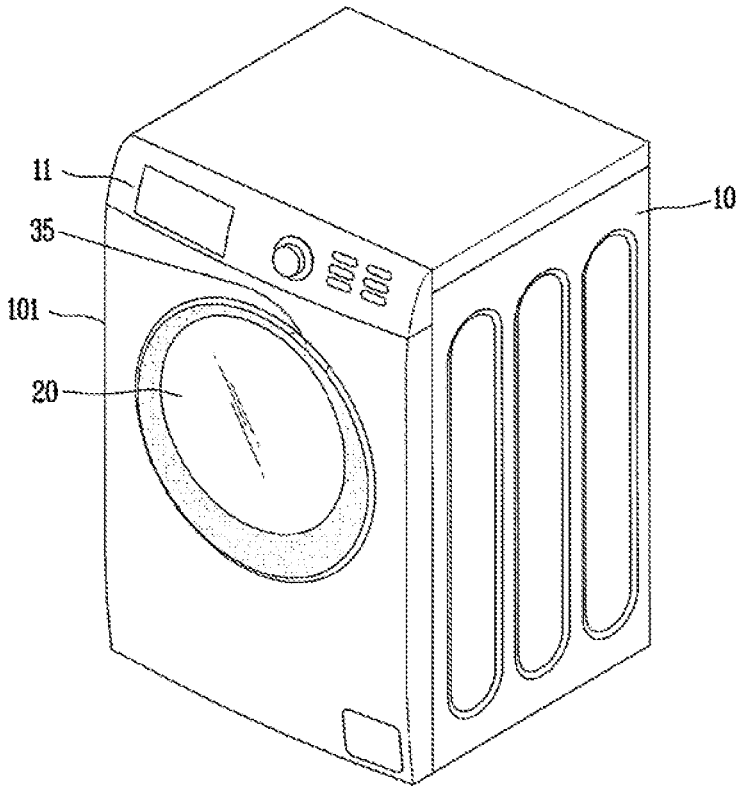
FIG. 1 is a perspective view showing a laundry treating apparatus according to an embodiment.

Hereinafter, embodiments will be described with reference to the accompanying drawings. In the drawings, the same or similar elements are designated with the same or similar reference numerals, and redundant description has been omitted. The suffixes "module" and "unit" for components or elements used in the following description are given or mixed in consideration of ease in creating specification, and do not have distinct meanings or roles. In describing embodiments, if a detailed explanation for a related known technology or construction is considered to unnecessarily divert the gist, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second may be used to describe various elements, but the elements are not limited by the terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

Singular expressions include plural expressions unless the context clearly indicates otherwise.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, elements, components or combinations thereof are not excluded in advance.

FIG. 1 is a perspective view of a laundry treating apparatus according to an embodiment. The laundry treating apparatus may include a main body 10, a tub, a drum, and a door 12.

The main body 10 may define an outer shape or appearance of the laundry treating apparatus. The main body 10 may have in a rectangular parallelepiped shape.

The main body 10 may include a front panel 101 defining a front surface of the laundry treating apparatus, a rear panel defining a rear surface of the laundry treating apparatus, side panels defining sides of the laundry treating apparatus, a top panel defining a top surface of the laundry treating apparatus, and a bottom panel defining a bottom surface of the laundry treating apparatus. The rear panel and the side panels may be defined in a "ㅌ" shape by bending one rectangular plate, thereby improving a structural rigidity of the main body 10.

Figure 5:
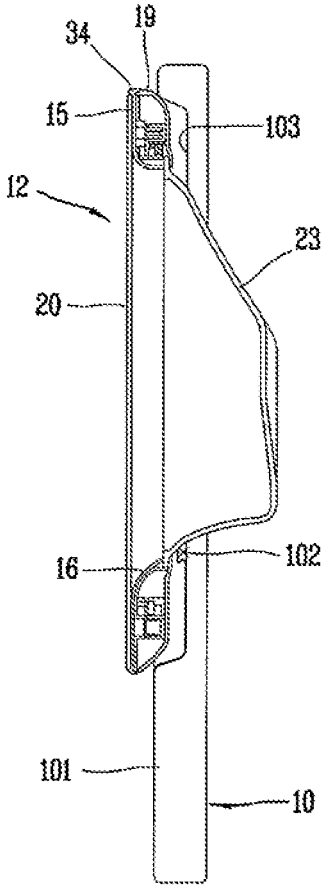
FIG. 5 is a cross-sectional view showing a state in which a door is mounted on a front panel of a main body to close a laundry input port.

A laundry inlet port 102 may be defined in a circular shape on the front panel 101 (see FIG. 5). The laundry inlet port 102 may pass through the front panel 101 so as to allow laundry to be put into a laundry accommodating portion through the laundry inlet port 102.

The laundry inlet port 102 may be formed in the front panel 101 and a recess 103 may be recessed toward an inside of the main body 10 to surround the laundry inlet port 102. The laundry inlet port 102 may pass through an inside of the recess 103. A portion of the door 12 may be accommodated in the recess 103.

The door 12 may be rotatably coupled to the front panel 101 by a hinge unit 24 to open and close the laundry input port 102. The laundry accommodating portion may be provided inside of the main body 10. The laundry accommodating portion may include a drum to perform a drying function, or a tub and a drum to perform washing and drying functions together.

In one embodiment, in order to perform a drying function along with a washing function, a tub and a drum may be provided inside of the main body 10. The tub may be defined in a cylindrical shape. A central shaft of the tub in a lengthwise direction may be disposed horizontally or in an inclined manner at a predetermined angle. Wash water may be stored inside of the tub. The drum may be rotatably provided inside of the tub.

A gasket may be provided at a front end portion of the tub to communicate with the laundry inlet port 102 so as to prevent the wash water stored inside of the tub from leaking into an accommodation space of the main body 10. The drum may be provided to be rotatable with respect to the tub inside of the tub.

A front portion of the drum may be open and in communication with the laundry input port 102. Laundry may be accommodated inside of the drum through the laundry input port 102.

A drive motor may be provided on a rear surface of the tub, and the drive motor may be connected to a rotational shaft on a rear surface of the drum to rotate the drum by transmitting power of the drive motor to the drum through the rotational shaft as the drive motor is driven. A plurality of through holes may be arranged on a circumferential surface of the drum to allow a fluid, such as wash water, to enter and exit the drum through the plurality of through holes. The drum may be configured to have a plurality of lifters therein to rotate laundry accommodated inside of the drum, thereby performing washing and drying functions.

A controller 11 may be provided in or on the main body 10 or provided in or on the door 12. In this embodiment, controller 11 is located above the front panel 101 of the main body 10.

The controller 11 may be configured to display information related to operation of the laundry treating apparatus to a user and to receive a user's input. The controller 11 may include a circular knob and a plurality of buttons for receiving the user's input. In addition, the controller 11 may include a display that displays visual information.

Figure 2:
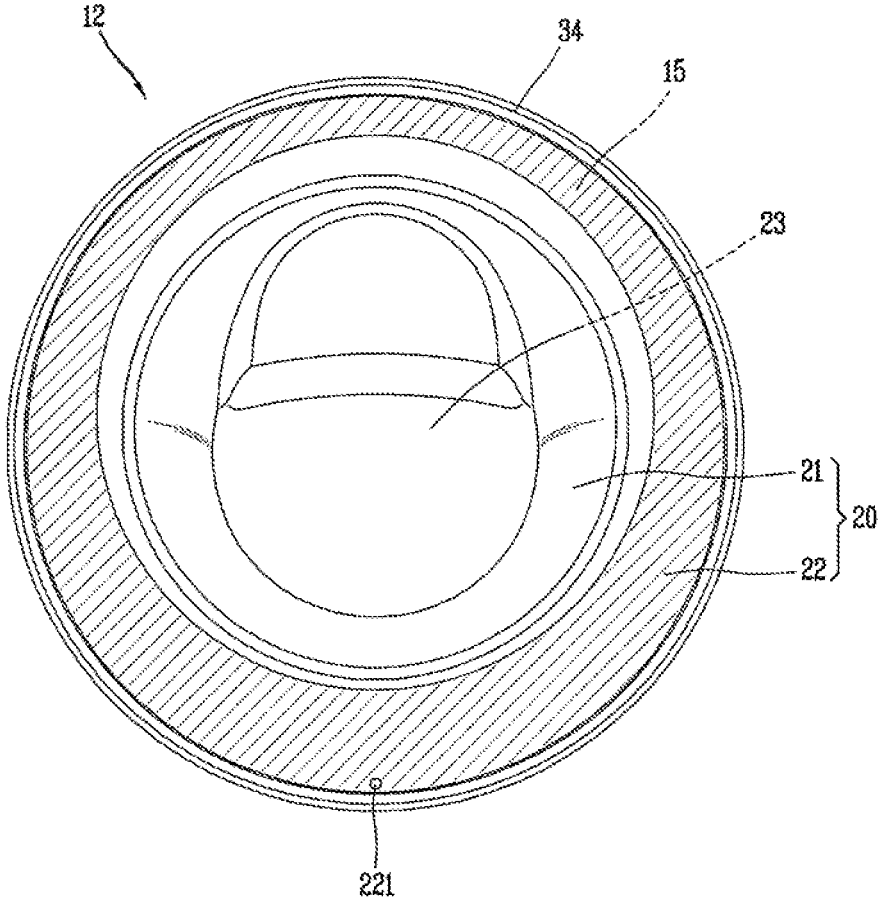
FIG. 2 is a front view of a door in FIG. 1.
Figure 3:
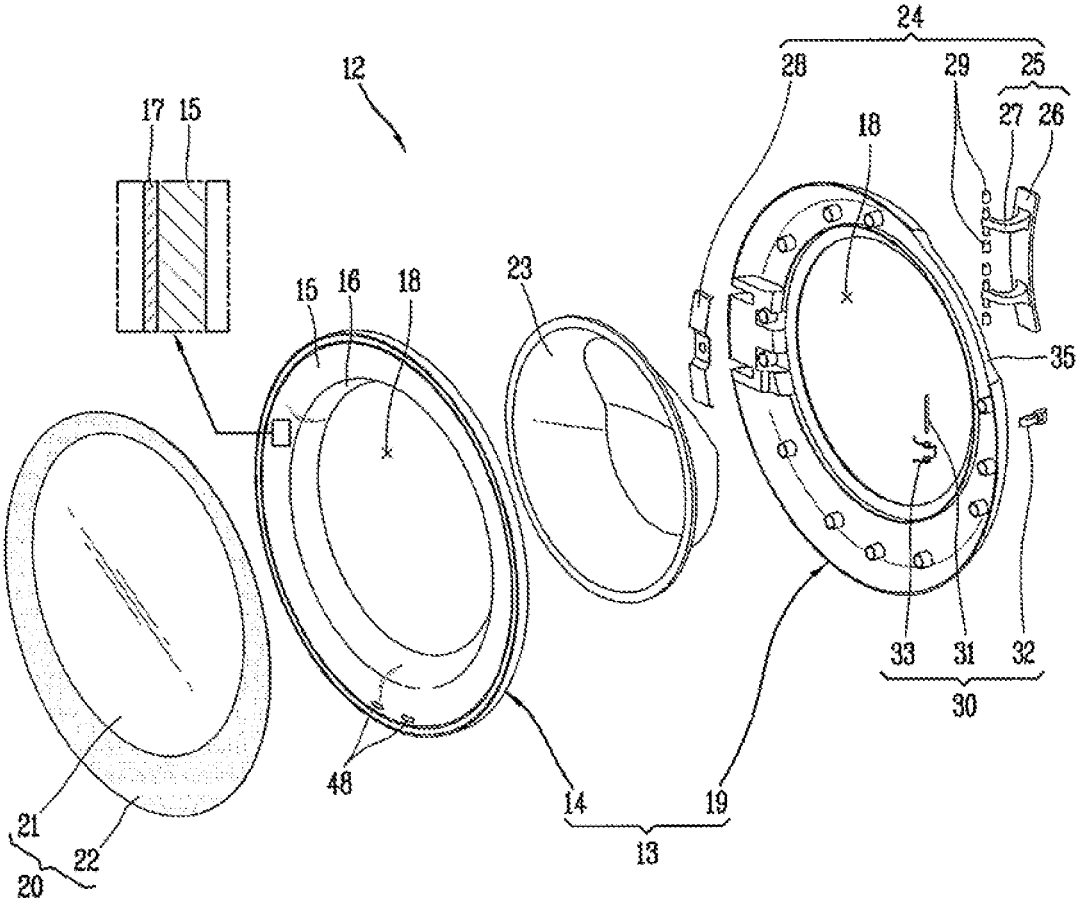
FIG. 3 is an exploded view of the door in FIG. 2.

FIG. 2 is a front view of the door 12 in FIG. 1. FIG. 3 is an exploded view of the door 12 in FIG. 2.

The door 12 may include a door frame 13, a door window 23, a front glass 20, a hinge unit 24, and a locking unit 30. The door frame 13 may have a ring shape.

The door frame 13 may include an outer frame 14 and an inner frame 19. The outer frame 14 and the inner frame 19 may be made of a synthetic resin material, such as an acrylonitrile butadiene styrene (ABS) material, or a polycarbonate (PC) material, for example. Each of the outer frame 14 and the inner frame 19 may be manufactured by injection molding, for example, when made of a synthetic resin material.

The outer frame 14 and the inner frame 19 each may have a ring shape, and may be overlapped and fastened to each other in a frontward-rearward direction. A fastening structure between the outer frame 14 and the inner frame 19 will be described hereinafter.

The outer frame 14 and the inner frame 13 are named as such as the outer frame 14 is disposed toward an outside of the main body 10 and the inner frame 19 is disposed toward an inside of the main body 10 based on a state in which the door 12 is closed. The outer frame 14 may be referred to as a "first frame", and the inner frame 19 may be referred to as a "second frame".

Circular openings 18 may be defined to correspond to each other in the outer frame 14 and the inner frame 19, respectively. The openings 18 may be eccentrically positioned at a center of each of the outer frame 14 and the inner frame 19. For example, the center of the opening 18 may be positioned above the center of each of the outer frame 14 and the inner frame 19.

According to this embodiment, each of the outer frame 14 and the inner frame 19 may vary in width along a circumferential direction. In other words, a distance (width) between an outer diameter and an inner diameter (the opening 18 diameter) of each of the outer frame 14 and the inner frame 19 may increase (widen) from a top end to a bottom end.

A center of the drum may be disposed higher than a center of a height (½) of the main body 10. The drum may be fixed in a heightwise direction of the main body 10 aside from minute vibration due to rotation.

Consumers tend to prefer a larger size of the door 12 to a same capacity and size of the washing machine when looking at the body 10 from the front. In addition, consumers are able to look into the drum through the door 12, and if possible, prefer to have a wide field of view with regard to an inner space of the drum.

In order to satisfy the needs of the above-mentioned consumers, the door 12 must be enlarged downward to increase the size of the door 12 while a position of the drum is fixed. A center of the door frame 13 must move below a center of the laundry inlet port 102 or the opening 18. Similarly, the center of the door frame 13 may move downward with respect to the door window 23 positioned to correspond to the opening 18.

In addition, in order to increase the size of the door 12, a portion of the door 12 may protrude outward from the recess 103. A diameter of the door 12 may be larger than the recess 103.

The front glass 20 may be defined in a circular shape having a predetermined radius. The front glass 20 may be made of a glass material.

The front glass 20 may have flat front and rear surfaces thereof. The front glass 20 may have a disc shape having a constant thickness, without bending, even when viewed from any direction, up, down, left, or right.

As described above, the front and rear surfaces of the front glass 20 made of a glass material may have a flat circular shape, thereby enhancing a quality grade of the door 12, compared to a door cover in the related art made of a synthetic resin material that has a convex front surface in an incomplete circular shape.

A transparent alignment mark 221 may be defined in a non-transparent region 22. The alignment mark 221 may be a structure for guiding an attachment position of the front glass 20 with respect to the outer frame 14. In this embodiment, a circular alignment mark 221 is positioned at a lower side (6 o'clock direction) of the front glass 20. However, embodiments are not necessarily limited thereto. The alignment mark 221 may be formed in a polygonal shape or may be formed in a line shape, for example. Of course, the position of the alignment mark 221 may be changed.

The front glass 20 may include a transparent region 21, the non-transparent region 22, and the alignment mark 221 in a layered structure. For an example, the front glass 20 may include a glass body made of a transparent glass material and a shielding layer disposed to cover a rear surface of the glass body to define the non-transparent region 22. In this case, a portion where the shielding layer is not disposed may define the transparent region 21 and the alignment mark 221. The shielding layer may be made by glass printing on a rear surface of the glass body, for example.

For another example, the front glass 20 may include a glass body made of a transparent glass material and a film disposed to cover a rear surface of the glass body. The film may include a transparent portion disposed to have a transparency corresponding to the transparent region 21, a non-transparent portion disposed to have an opacity corresponding to the non-transparent region 22, and the alignment mark 221 disposed to have a transparency corresponding to the alignment mark 221.

For still another example, the front glass 20 may include a glass body made of a transparent glass material and a film disposed to cover a rear surface of the glass body. There is a difference from the above example in that the film includes a first hole disposed to correspond to the transparent region 21, a non-transparent portion disposed to have an opacity corresponding to the non-transparent region 22, and a second hole disposed to correspond to the alignment mark 221. In other words, there is a difference in whether a portion corresponding to the transparent region 21 and the alignment mark 221 in the film is disposed to have a transparency or has a perforated shape.

The front glass 20 may cover the opening 18 of the door frame 13. The front glass 20 may be bonded to a front surface of the outer frame 14 by a sealant or an adhesive, for example.

Due to a nature of the glass material, it is easy to break when a fastening hole is drilled in the front glass 20, and thus, the front glass 20 is attached to the outer frame 14 using an adhesive, for example, to prevent the glass from being broken. On the other hand, the front glass 20 made of a glass material occupies a relatively large load compared to a total load of the door 12. In order to support the load of the front glass 20, a mounting guide 34 that mounts the front glass 20 may be provided on a front surface of the outer frame 14.

In particular, the front glass 20 may be made of tempered glass. Due to a nature of tempered glass, front and rear surfaces of the front glass 20 have a high strength, but a circular outer circumferential surface, which is a side surface of the front glass 20, has a low strength. To compensate for this, the mounting guide 34 may be disposed to protrude forward from a front outer circumferential end of the outer frame 14 to surround an outer circumferential surface of the front glass 20, to support the load of the front glass 20 as well as to protect a side or outer circumferential surface of the front glass 20 from an external shock.

A protruding length of the mounting guide 34 may be defined to cover at least ⅔ of the thickness of the front glass 20. This is because an external impact can be applied to the outer circumferential surface of the front glass 20, and the load of the front glass 20 cannot be sufficiently supported when the protruding length of the mounting guide 34 is too short.

Figure 7:
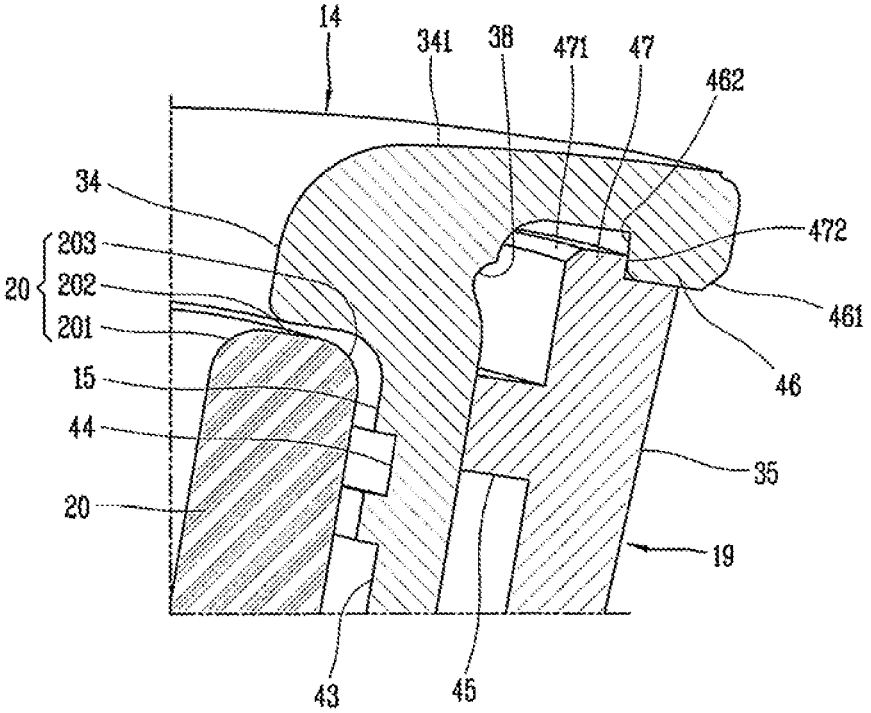
FIG. 7 is a cross-sectional view showing a hook fastening structure between an outer frame and a handle, taken along line VII-VII in FIG. 4.

For example, a straight portion 202 and a plurality of curved portions 201, 203 may be arranged on the outer circumferential surface of the front glass 20 (see FIG. 7). The plurality of curved portions 201, 203 may include a first curved portion 201 connected to the front surface of the front glass 20 and a second curved portion 203 connected to the rear surface of the front glass 20. Each of the curved portions 201, 203 may have a predetermined curvature and be defined in a curved shape.

The straight portion 202 may be disposed between the first and second curved portions 201, 203 and connected to the plurality of curved portions 201, 203, respectively. Each of the first curved portion 201, the straight portion 202, and the second curved portion 203 may be ⅓ of the thickness of the front glass 20.

The mounting guide 34 may cover the second curved portion 203 and the straight portion 202 of the front glass 20. The mounting guide 34 may protrude from a front edge portion or edge of the outer frame 14. The mounting guide 34 may extend in a ring shape to define a space in which the front glass 20 may be accommodated.

The mounting guide 34 may have a predetermined inner diameter to define a circle. The inner diameter of the mounting guide 34 may correspond to an outer diameter of the front glass 20, and thus, the mounting guide 34 may surround the outer circumferential surface of the front glass 20.

The transparent region 21 and the non-transparent region 22 may be disposed at inner and outer sides of the front glass 20, respectively. The transparent region 21 denotes a region configured to transmit at least a portion of light so that an inside of the laundry accommodating portion may be viewed by the user. Therefore, the transparent region 21 may include a translucent region.

The transparent region 21 may be disposed to correspond to the opening 18 of the outer frame 14, the opening 18 of the inner frame 19, and the door window 23. While the door 12 is closed, the user may look into the laundry accommodating portion through the transparent region 21.

A center of the transparent region 21 may be located at a position corresponding to a center of the opening 18 of each of the outer frame 14 and the inner frame 19. The corresponding position may include not only perfect alignment with the center, but also, alignment in an eccentric direction of the center. In other words, the center of the transparent region 21 and the center of the opening 18 may coincide, and the eccentric direction of the transparent region 21 may be the same as the eccentric direction of the opening 18.

In this embodiment, the center of the opening 18 is eccentrically located from the center of the door frame 13 to an upper side (12 o'clock direction), and correspondingly, the center of the transparent region 21 is also located from the center of the front glass 20 to the upper side (12 o'clock direction). The center of the transparent region 21 and the center of the opening 18 may coincide.

The non-transparent region 22 may surround the transparent region 21. The non-transparent region 22 does not transmit light therethrough, and thus, the glass itself may appear black in the non-transparent region 22. The non-transparent region 22 may cover a remaining portion of the door frame 13 except for the opening 18 and a portion of the door frame 13.

A boundary line between the transparent region 21 and the non-transparent region 22 surrounding the transparent region 21 may be clearly distinguished by the non-transparent region 22. Alternatively, the boundary between the transparent region 21 and the non-transparent region 22 may be blurred through a halftone technique, thereby providing a visual transition from the transparent region 21 to the non-transparent region 22. The non-transparent region 22 may include a plurality of shielding dots arranged around the transparent region 21, and the plurality of shielding dots may be arranged to have a lower density toward the transparent region 21.

The outer frame 14 may include a flat portion 15 and a curved portion 16. The flat portion 15 may be in contact with a rear surface of the front glass 20, and a portion of the flat portion 15 may overlap with the non-transparent region 22. An adhesive may be applied to the flat portion 15 so that the front glass 20 may be adhered to the flat portion 15.

An adhesive groove 43 for receiving an adhesive on a front surface of the flat portion 15 of the outer frame 14 may be recessed in a thickness direction of the flat portion 15 on the front surface of the flat portion 15. The adhesive may be accommodated in the adhesive groove 43, and a rear surface of the front glass 20 may be adhered to the flat portion 15 by the adhesive.

The adhesive may overflow radially to an outside or an inside of the adhesive groove 43 when the adhesive groove 43 is filled. In order to accommodate the adhesive overflowing from the adhesive groove 43, adhesive overflow grooves 441, 442 may be recessed in a ring shape at the inside and the outside of the adhesive groove 43, respectively (see FIG. 6).

The adhesive groove 43 and the plurality of adhesive overflow grooves 441, 442 may extend in the circumferential direction of the outer frame 14. The adhesive groove 43 and the plurality of adhesive overflow grooves 441, 442 may be disposed radially outside of the flat portion 15. The non-transparent region 22 of the front glass 20 may cover the adhesive groove 43 and the plurality of adhesive overflow grooves 441, 442 of the flat portion 15.

The plurality of adhesive overflow grooves 441, 442 may include first adhesive overflow groove 441 and second adhesive overflow groove 444. The first adhesive overflow groove 441 may have a ring shape at the outside of the adhesive groove 43 in a radial direction. The second adhesive overflow groove 442 may have a ring shape at the inside of the adhesive groove 43. The plurality of adhesive overflow grooves 441, 442 may accommodate the adhesive when the adhesive overflows after filling adhesive in the adhesive groove 43.

A plurality of water drain holes 48 may be arranged in a penetrating manner at a lower side of the flat portion 15 in the thickness direction, to discharge water or moisture (liquid) formed between the rear surface of the front glass 20 and the front surface of the outer frame 14 to outside of the door 12 through the plurality of water drain holes 48.

The curved portion 16 may be curved in an arc shape having a predetermined curvature toward an outer circumference of the opening 18 of the inner frame 19 from an inner end of the flat portion 15. An inner portion of the flat portion 15 and the curved portion 16 may overlap with an outer edge portion or edge of the transparent region 21. The opening 18 may be disposed at an inside of the curved portion 16 in the radial direction.

The mounting guide 34 may protrude from the flat portion 15 along the circumferential direction at an outermost portion of the flat portion 15. The mounting guide 34 of the outer frame 14 may surround the outer circumferential surface of the front glass 20, thereby preventing the outer circumferential surface of the front glass 20 from being released radially outward from the flat portion 15 of the outer frame 14.

A plating layer 17 may be disposed on front and outer circumferential surfaces of the outer frame 14 by chromium plating, for example. The outer frame 14 may be completely immersed in a chromium plating solution, and thus, the plating layer 17 may be disposed on an entire surface of the outer frame 14 by chromium plating.

The plating layer 17 may coat the outer frame 14 with a silver polished metal color. Accordingly, the plating layer 17 may obtain an effect which looks like bright silver circular droplets. In addition, the plating layer 17 may cause a sense of high quality when viewed with the naked eye.

The door window 23 may be disposed to correspond to the laundry input port 102 when the door 12 is closed. The door window 23 may be mounted to the door frame 13 to correspond to the opening 18 of the inner frame 19.

The door window 23 may be made of a transparent material, for example, a synthetic resin material having a light transmitting property, so that an inner space of the laundry accommodating portion, such as a drum, may be viewed through the door window 23. The door window 23 may not be necessarily limited to a synthetic material, but may also be made of a glass material.

An outer edge portion or edge of the door window 23 may be inserted and coupled between the outer frame 14 and the inner frame 19. The outer edge portion of the door window 23 may have a flat shape, and may be fixed between a rear end of the curved portion 16 of the outer frame 14 and an inner end of the inner frame 19.

A first portion of the outer frame 14 and the inner frame 19 may protrude forward from the recess 103 in a closed state of the door 12, and a second portion of the outer frame 14 and the inner frame 19 may be accommodated in the recess 103.

The flat portion 15 of the outer frame 14 may be disposed outside of the recess 103, and may protrude forward from the recess 103, and a rear end portion or end of the curved portion 16 of the outer frame 14 may be accommodated inside of the recess 103.

A front portion of an outer circumference of the inner frame 19 may protrude outward from the recess 103, and a rear portion of the outer circumference portion of the inner frame 19 may be accommodated in the recess 103. The front glass 20 may be spaced apart in an outward-forward direction from the recess 103, and disposed vertically.

The door 12 may be rotatably provided in the frontward-rearward direction with respect to the main body 10 by the hinge unit 24. The hinge unit 24 may include a hinge 25, a hinge holder 28, and a bush 29.

The hinge 25 may be fixed to the main body 10, and rotatably coupled to the door frame 13. The hinge 25 may include a plate-shaped base 26 coupled to the main body 10, and a rotation coupling portion 27 that protrudes from the base 26 and is rotatably coupled to the door frame 13. A plurality of rotation coupling portions 27 may be provided and spaced apart in a vertical direction.

The hinge holder 28 may be coupled to the door frame 13 to support the plurality of rotation coupling portions 27 to prevent the plurality of rotation coupling portions 27 from being released from the door frame 13. The bush 29 may be inserted onto a rotational shaft of the rotary coupling portion 27 to efficiently rotate the rotational shaft.

The hinge unit 24 may be mounted at one or a first side of the door 12, and the locking unit 30 may be provided at the other or a second side of the door 12. The locking unit 30 is configured to lock or unlock the door 12 to the body 10.

The locking unit 30 may include a shaft 31, a door latch 32 (door latch), and a spring 33. The shaft 31 may pass through the door latch 32, and be mounted on the door frame 13. The spring 33 has an elastic force to be retractable during rotation of the door latch 32. According to this embodiment, the door latch 32 may be configured to be rotatable and restorable to the door frame 13 so as to lock or unlock the door 12 to the main body 10.

Figure 4:
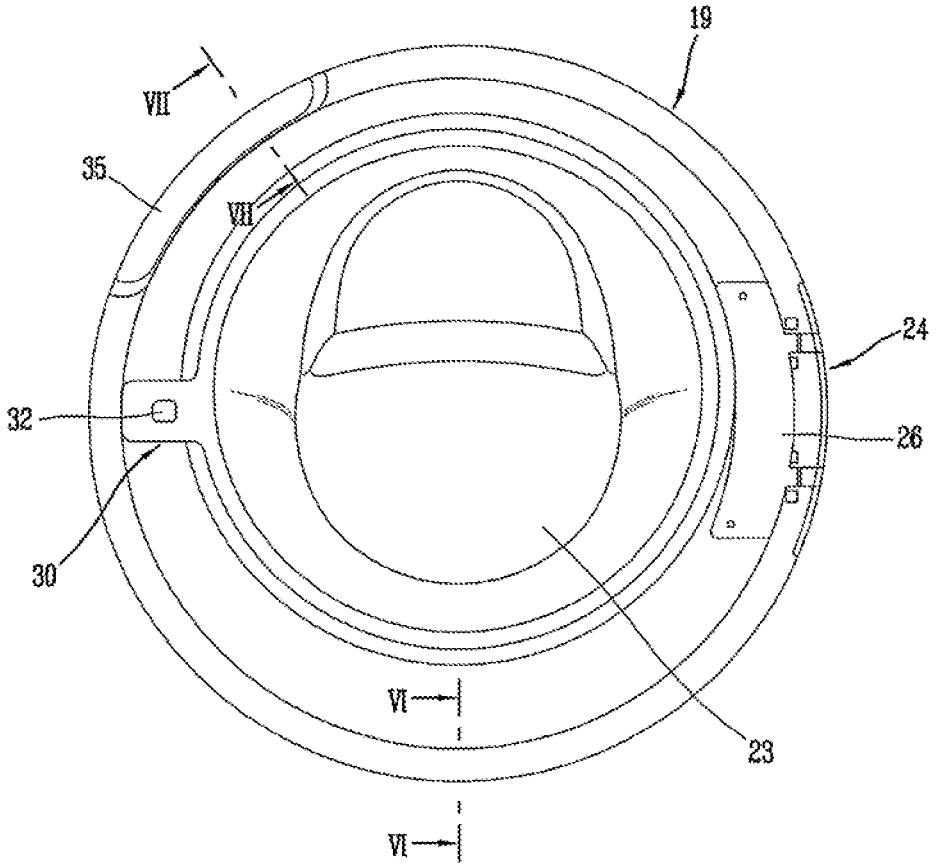
FIG. 4 is a rear view of the door in FIG. 2.
Figure 6:
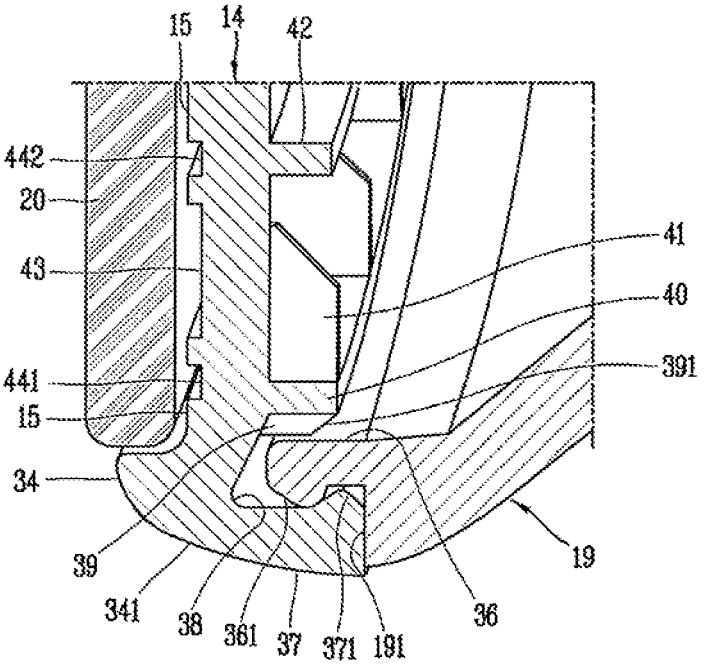
FIG. 6 is a cross-sectional view of a hook fastening structure between an outer frame and an inner frame, taken along line VI-VI in FIG. 4.
Figure 8:
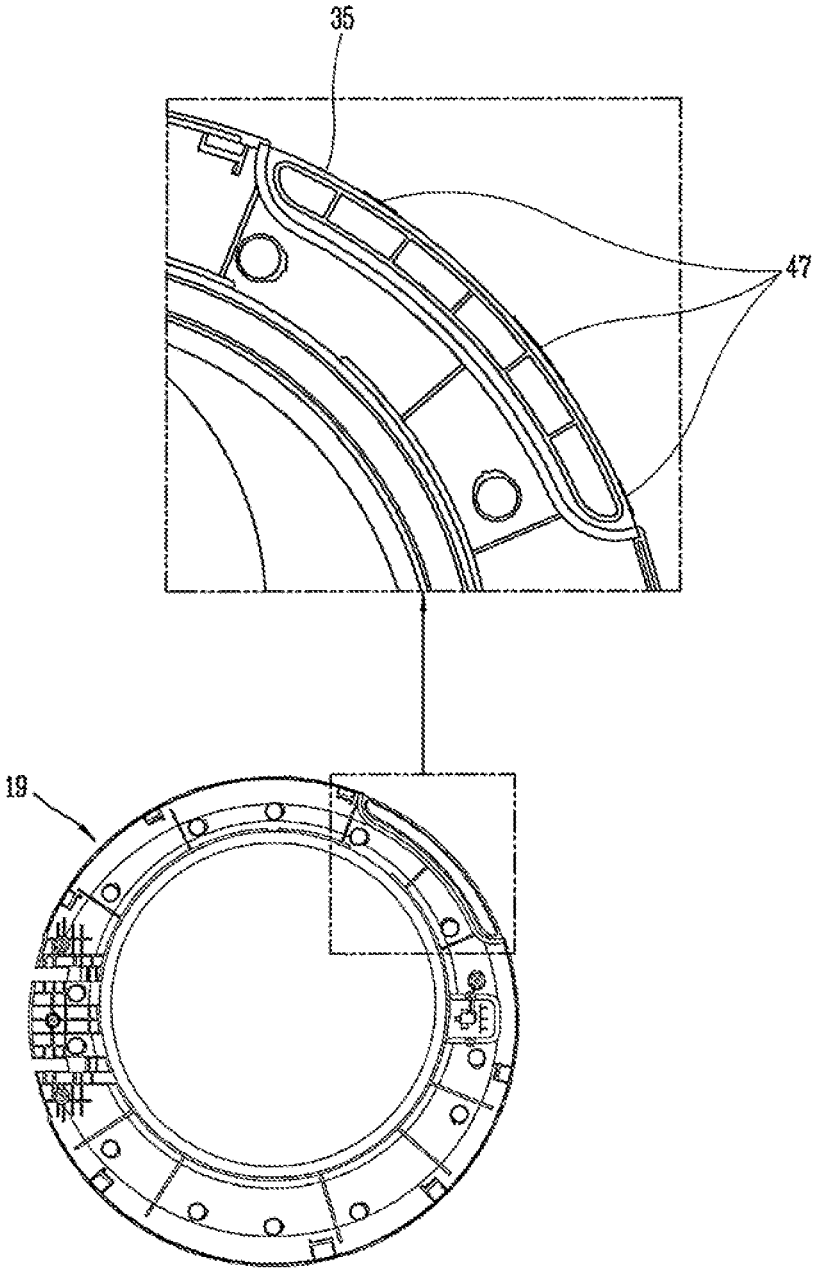
FIG. 8 is a view showing a state in which a hook is partially disposed on the handle as the inner frame in FIG. 4 viewed from the front.

FIG. 4 is a rear view of the door 12 in FIG. 2. FIG. 5 is a cross-sectional view showing a state in which the door 12 is mounted on the front panel 101 of the main body 10 to close the laundry input port 102. FIG. 6 is a cross-sectional view showing a hook fastening structure between the outer frame 14 and the inner frame 19, taken along line VI-VI in FIG. 4. FIG. 7 is a cross-sectional view showing a hook fastening structure between the outer frame 14 and a handle 35, taken along line VII-VII in FIG. 4. FIG. 8 is a view showing a state in which a hook is partially disposed on the handle 35 as the inner frame 19 in FIG. 4, viewed from the front.

FIG. 5 shows a state in which the controller of FIG. 1 is removed from an upper side of the front panel 101. A contact portion 192 may be provided on a rear surface of the inner frame 19. The contact portion 192 may be configured to contact a portion where a depression of the recess 103 starts when the door 12 is closed.

The contact portion 192 may have an arc-shaped cross section, and may be defined in a curved shape. The contact portion 192 may be convex toward the portion where the depression of the recess 103 starts. The portion where the depression of the recess 103 starts may be defined in an arc-shaped curved surface having a smaller diameter than the contact portion 192.

The contact portion 192 and the recess 103 may be opposed to each other. The contact portion 192 may extend along the circumferential direction at an upper rear side of the inner frame 19 with respect to a horizontal line passing radially through the center of the door 12. An upper rear surface of the inner frame 19 may contact the portion where the depression of the recess 103 starts, but a lower rear surface of the inner frame 19 may not contact the portion where the depression of the recess 103 starts. In other words, the upper and lower rear surfaces of the inner frame 19 may have an asymmetrical structure.

A circumferential length of the contact portion 192 may not be greater than a half of an entire circumference in the circumferential direction of the inner frame 19. The contact portion 192 may be in point contact or line contact with the portion where the depression of the recess 103 starts.

According to this embodiment, the contact portion 192 may be in contact with the portion where the depression of the recess 103 starts when the door is closed, thereby preventing a lifting phenomenon of the door 12 even when laundry rotating along an inner circumferential surface of the drum collides with the door window 23 when a large amount of laundry is loaded in the laundry treating apparatus.

That is, when a large amount of laundry is loaded inside of the drum, the laundry may move to a lower portion of the drum under the influence of gravity and centrifugal force while wet with water, and the laundry may hit a lower portion of the door window 23 while being rotated. When an impact is applied to the door window 23 by the rotation of the laundry, a lower rear portion of the door frame 13 is pressurized from an inside of the drum toward the outside.

In a state where the hinge unit 24 and the locking unit 30, which are disposed at the rear lateral sides of the door frame 13, respectively, are fixed to the recess 103, the contact portion 192 may be brought into contact with the portion where the depression of the recess 103 starts to resist against the lifting of the door 12, thereby preventing the lifting of the door 12 even when an impact is applied to a lower portion of the door frame 13. In addition, the contact portion 192 may maintain a state of being in contact with the portion where the depression of the recess 103 starts when the door 12 is closed, thereby minimizing vibration and noise generated between the door 12 and the main body 10 even when an impact is repeatedly applied through the door window 23 from the laundry accommodated inside of the drum.

The contact portion 192 may extend in an arc-shaped curved surface along the circumferential direction of the door frame 13, such that the contact portion 192 is harmonized with a smooth curved surface without bending compared to a circumferential portion of the contact portion 192 rather than a structure protruding from one rear side of the door frame 13, and there is an advantage of beautifying the appearance of the door 12. In particular, the contact portion 192 is in contact with the portion where the depression of the recess 103 starts to cover a gap between the recess 103 and the door window 23, thereby improving an appearance quality of the door 12.

Referring to FIGS. 4 and 5, the handle 35 may be provided in a recessed manner at a rear upper side of the inner frame 19 for the user to open the door 12 by pulling the handle 35. A rear surface of the inner frame 19 may be convex rearward in a curved shape.

The handle 35 may be provided on the door 12 for the user to open and close the door 12. In the related art, the handle is generally provided at a front side of the door. However, in embodiments, as the front glass 20 is provided to cover a front surface of the door 12, it is difficult to provide the handle 35 on the front glass 20. Thus, the handle 35 is not provided on the front surface of the door 12 due to the front glass 20, but rather, may be provided on a rear surface of the door 12. The handle 35 may be provided on the inner frame 19.

In addition, the handle 35 may be provided at an upper portion of the door 12 for the user to easily pull the door 12. When the handle 35 is provided at a lower portion of the door 12, the user has to bend his or her waist and knees more to pull the handle 35.

Moreover, as the hinge unit 24 and the locking unit 30 are respectively provided at lateral sides of the door frame 13 along a horizontal center line that horizontally passes through a center of the door frame 13 in the radial direction, they may be positioned higher than the horizontal center line. In addition, the handle 35 may be disposed above the door frame 13 to be higher than the locking unit 30 in order to open and close the door 12 with little force.

The handle 35 may be disposed at a rear upper side of the inner frame 19. While the door 12 is closed, the handle 35 may be disposed at an upper right side to be higher than the locking unit 30 when viewed from the front of the main body 10, that is, within a section between 1 o'clock and 3 o'clock along the circumferential direction in a clockwise direction.

The handle 35 may be disposed in a recessed manner on a rear surface of the inner frame 19. The handle 35 may have an arc shape along a partial section in the circumferential direction on the rear surface of the inner frame 19. The handle 35 may have a thin and flat shape compared to an outer circumference of the inner frame 19 (a portion other than the handle 35).

According to this embodiment, when the door 12 is closed by the user, the handle 35 is recessed forward compared to a rear outer circumference of the inner frame 19 and defined in a flat shape when viewed from the front of the main body 10, thereby facilitating insertion of the user's hand into the handle 35 as well as facilitating identification of a position of the handle 35 in the closed state of the door 12.

In order to fasten the outer frame 14 and the inner frame 19 to each other, hooks 37, 36 may be disposed on the outer frame 14 and the inner frame 19, respectively. The hooks 37, 36 may include first hook 37 provided on the outer frame 14 and second hook 36 provided on the inner frame 19. Each of the first hook 37 and the second hook 36 may have a ring shape along the circumferential direction. The first and second hooks 37, 36 may be coupled to each other by an interference or snap fit to couple the outer frame 14 and the inner frame 19.

The first hook 37 may protrude from the outer frame 14 toward the inner frame 19. The first hook 37 may be disposed outside in the radial direction of the mounting guide 34 to surround an outer circumference of the inner frame 19. The first hook 37 may be disposed outside of the mounting guide 34 when viewed from the front of the main body 10.

The mounting guide 34 and the first hook 37 may be integrally connected by extension portion 341. The extension portion 341 may extend from the mounting guide 34 to the first hook 37. The extension portion 341 may extend from the mounting guide 34 to the first hook 37 to gradually increase in diameter. The extension portion 341 may have a curved shape.

Each of the mounting guide 34, the first hook 37, and the extension portion 341 may extend along the circumferential direction of the outer frame 14. According to this embodiment, the mounting guide 34, the extension portion 341, and the first hook 37 may define an outer circumferential surface of the outer frame 14 in one curved shape to cover the inner frame 19 so as to cover up the main body 10 when viewed from the front of the main body 10, thereby beautifying the appearance of the door 12. Each of the mounting guide 34, the extension portion 341, and the first hook 37 may have a curved or inclined surface shape so that a diameter thereof increases gradually from the mounting guide 34 to the first hook 37 without wrinkles or steps.

The first hook 37 and the second hook 36 may radially overlap with each other. The first hook 37 may have a larger diameter than the second hook 36, and the second hook 36 may be inserted into the first hook 37.

A mounting groove 191 may be disposed between an outer circumferential end of the inner frame 19 and the second hook 36 along the circumferential direction. The second hook 36 may be disposed in a stepped manner radially inward from the outer circumferential end of the inner frame 19. A radial height of the mounting groove 191 may be the same or similar to a thickness of the first hook 37.

According to this embodiment, when the outer frame 14 and the inner frame 19 are fastened to each other, there is no step between an outer circumferential end of the first hook 37 and the outer circumferential end of the inner frame 19, thereby beautifying the appearance of the door 12.

The first hook 37 may protrude backward from an outer circumference of the outer frame 14 toward the inner frame 19. A hook protrusion 371 may protrude radially inward toward the second hook 36 on an inner circumferential surface of the first hook 37.

The second hook 36 may protrude forward from an outer circumference of the inner frame 19 toward the outer frame 14. A hook protrusion 361 may protrude radially outward toward the first hook 37 on an outer circumferential surface of the second hook 36. The hook protrusion 371 of the first hook 37 and the hook protrusion 361 of the second hook 36 may protrude parallel to each other in the radial direction.

The hook protrusions 371, 361 may have a wedge shape at each end portion of each of the first hook 37 and the second hook 36. The hook protrusion 371 of the first hook 37 and the hook protrusion 361 of the second hook 36 may overlap with each other in an axial direction. The hook protrusions 371, 361 may facilitate engagement between the first hook 37 and the second hook 36 toward each other but do not allow them from being released from each other in opposite directions.

Each of the hook protrusion 371 of the first hook 37 and the hook protrusion 361 of the second hook 36 may be configured with a first inclined surface in contact with each other prior to fastening and a second inclined surface inclined on an opposite side of the first inclined surface to be in contact with each other subsequent to fastening. The first inclined surface and the second inclined surface change inclinations of the hook protrusions 371 and 361 in opposite directions with respect to vertices of the hook protrusions 371 and 361, respectively.

The slopes of the first inclined surface and the second inclined surface may be different from each other. The first inclined surface of each of the hook protrusions 371, 361 facing each other prior to fastening may be disposed to have a lower slope than the second inclined surface of each of the hook protrusions 371 and 361 facing each other subsequent to fastening. In other words, the second inclined surface of each of the hook protrusions 371 and 361 facing each other subsequent to fastening may have a higher slope than the first inclined surface of each of the hook protrusions 371, 361 facing each other prior to fastening.

According to this embodiment, the first hook 37 and the second hook 36 may move toward each other in the axial direction to engage the hook protrusions 371, 361 with each other, thereby fastening the outer frame 14 and the inner frame 19. Moreover, the wedge-shaped hook protrusions 371, 361 may facilitate engagement between the first hook 37 and the second hook 36 toward each other, but prevent them from being released from each other in opposite directions as long as there is no damage of the first hook 37 or the second hook 36.

In other words, when the first hook 37 and the second hook 36 move toward each other in the axial direction to fasten the outer frame 14 and the inner frame 19, a movement resistance between the hook protrusions 371, 361 prior to fastening may be reduced, and the hook protrusions 371, 361 may be restricted from moving in a direction of being released from each other while the second inclined surfaces are brought into contact with each other subsequent to fastening the first hook 37 and the second hook 36.

The outer frame 14 may be provided with an elastic groove 38 and a pressing portion to support the heavy load of the front glass 20 and to firmly maintain a hook fastening structure between the outer frame 14 and the inner frame 19. The pressing portion may include a plurality of pressing ribs 39, connecting ribs 40, and support ribs 41.

The elastic groove 38 may be disposed radially inward from the first hook 37 on a rear surface of the outer frame 14. The elastic groove 38 may be concave in the thickness direction of the flat portion 15 on the rear surface of the flat portion 15 of the outer frame 14. The elastic groove 38 may be more concave in the thickness direction of the flat portion 15 at an inner side of the first hook 37 so that a thickness of the first hook 37 decreases, thereby allowing the first hook 37 to be elastically deformed radially outward.

According to this embodiment, when the second hook 36 enters an inside of the first hook 37 in the axial direction, the hook protrusion 371 of the first hook 37 may spread outward in the radial direction while the hook protrusion 371 of the first hook 37 and the hook protrusion 361 of the second hook 36 are brought into contact with each other, thereby facilitating the hook protrusion 361 of the second hook 36 to enter an inside of the hook protrusion 371 of the first hook 37. In addition, as a radial pressing force between the hook protrusion 371 of the first hook 37 and the hook protrusion 361 of the second hook 36 is released while the hook protrusion 361 of the second hook 36 passes through a highest point of the hook protrusion 371 of the first hook 37, the first hook 37 is restored to its original position from the deformed position, thereby allowing the hook protrusion 371 of the first hook 37 and the hook protrusion 361 of the second hook 36 to be engaged with each other.

A plurality of pressing ribs 39 may be arranged on a rear surface of the flat portion 15. The plurality of pressing ribs 39 may protrude from a rear surface of the flat portion 15 to be brought into contact with an inner circumferential surface of the second hook 36 so as to press the second hook 36 when fastening between the first hook 37 and the second hook 36. The plurality of pressing ribs 39 may be spaced apart from each other in the circumferential direction of the flat portion 15.

According to this embodiment, the plurality of pressing ribs 39 presses the inner circumferential surface of the second hook 36 radially outward when fastening between the first hook 37 and the second hook 36. Accordingly, as the second hook 36 is not pushed inward in the radial direction, a fastening state between the outer frame 14 and the inner frame 19 may be firmly maintained without being axially released from each other after the hook protrusions 361, 371 of each of the first hook 37 and the second hook 36 are fastened to each other.

In addition, the plurality of pressing ribs 39 may press the second hook 36, thereby enhancing a coupling force between the outer frame 14 and the inner frame 19. The plurality of pressing ribs 39 may be located radially inward from the elastic grooves 38 on the rear surface of the outer frame 14.

An entry guide surface 391 may be inclined toward the elastic groove 38 on a rear surface of the pressing rib 39. The entry guide surface 391 may guide movement of the second hook 36 to guide the second hook 36 to be inserted between the plurality of pressing rib 39 and the first hook 37. The entry guide surface 391 may facilitate entry of the second hook 36 into the first hook 37, thereby improving assembly performance.

Thus, the interference or snap fit of the first and second hooks 37, 36 may function as follows. The first inclined surface of the hook protrusions 371, 361, then the second inclined surfaces of the hook protrusions 371, 361 interact as the second hook 36 enters into the first hook 37, the first hook 37 flexing to accommodate the second hook and the entry guide surface 391 facilitating entry of the second hook 36 into the first hook 37. Once the second hook 36 has entered or been coupled to the first hook 37, the second inclined surfaces as well as the plurality of pressing ribs function to maintain the coupling between the first hook 36 and the second hook 37, and thus, the outer frame 14 and the inner frame 19.

The connecting rib 40 may protrude in a rearward direction on the rear surface of the outer frame 14, and may extend along the circumferential direction in a ring shape. The connecting rib 40 may connect the plurality of pressing ribs 39.

The connecting rib 40 may protrude from an opposite side of the first adhesive overflow groove 441 toward the inner frame 19 on the rear surface of the flat portion 15. Some or all of the connecting ribs 40 may overlap in the thickness direction of the first adhesive overflow groove 441 and the flat portion 15. According to this embodiment, the connecting rib 40 may compensate for a reduction in rigidity caused by a smaller thickness of one side of the flat portion 15 due to the adhesive overflow groove 441.

The elastic groove 38 may be disposed between the connecting rib 40 and the first hook 37. The elastic groove 38 may have an inner inclined surface inclined so that a thickness of the flat portion 15 gradually decreases from the connecting rib 40 to the first hook 37.

A plurality of support ribs 41 may protrude from a rear surface of the outer frame 14. The plurality of support ribs 41 may have a trapezoidal plate structure to extend vertically in the radial direction.

The plurality of support ribs 41 may be spaced apart in the circumferential direction. One side of each of the plurality of support ribs 41 may be integrally connected to a rear surface of the flat portion 15. An outer surface perpendicular to one or a first side of the plurality of support ribs 41 may be integrally connected to the connecting rib 40, and thus, the plurality of support ribs 41 may be connected to one another by the connecting rib 40. The other or a second side of the support ribs 41 positioned on a side opposite to the first side of the support ribs 41 may be disposed in parallel to the flat portion 15.

According to this embodiment, the plurality of support ribs 41 may be integrally arranged to be in direct contact with an inner surface of the connecting rib 40 and the flat portion 15 so as to firmly support the connecting rib 40 and the plurality of pressing ribs 39.

The plurality of pressing ribs 39 and the plurality of support ribs 41 may face each other in the radial direction at inner and outer sides of the connecting rib 40 by interposing the connecting rib 40 therebetween. The plurality of support ribs 41 may overlap with each other in the thickness direction of the adhesive groove 43 and the flat portion 15 on the rear surface of the flat portion 15. According to this embodiment, the plurality of support ribs 41 may compensate for weakening of the rigidity of the flat portion 15 due to the adhesive groove 43.

A reinforcing rib 42 may protrude from an opposite side of the second adhesive overflow groove 442 disposed at the inside of the adhesive groove 43 between adhesive overflow grooves 441, 442 on the rear surface of the flat portion 15. The reinforcing rib 42 may overlap with the second adhesive groove 442 in the thickness direction of the flat portion 15. According to this embodiment, the reinforcing rib 42 may compensate for weakening of the flat portion 15 due to the adhesive overflow groove 442.

The handle 35, which is a portion of the inner frame 19, has a lower thickness than a portion other than the handle 35 on an outer edge portion or edge of the inner frame 19. The handle 35 does not axially cover an outer surface of the first hook 37 of the outer frame 14.

The handle 35 may be defined in a plate shape. The handle 35 may be inclined to increase in thickness from an inner side to an outer side of the inner frame 19 in the radial direction thereof. According to this embodiment, the thickness may increase from an inner side to an outer side of the handle 35 in the radial direction thereof, thereby minimizing the user's finger from slipping radially outward from a rear surface of the handle 35 when the user pulls the handle 35 by his or her hand.

A handle pad 351 may be attached to a rear surface of the handle 35. The handle pad 351 may have a constant thickness. The handle pad 351 may be made of a rubber material, for example. The handle pad 351 may prevent the user's hand from slipping.

A tapered portion may be inclined at a radially outer side of the handle pad 351. An end portion or end of the tapered portion may correspond to a rear end portion or end of the hook 46. According to this embodiment, a step may be eliminated between the hook 46 of the outer frame 14 and the tapered portion of the handle pad 351, thereby allowing the user's finger to easily enter a rear surface of the handle 35 so as to pull the handle 35 of the door 12 by his or her hand, and allowing the outer frame 14 and the handle 35 to implement a simpler appearance.

A hook fastening structure between the handle 35 and the outer frame 14 is somewhat different from that between the inner frame 19 and the outer frame 14. A plurality of hook coupling portions 47 of the handle 35 may be spaced apart in a circumferential direction of the handle 35. Each of the hook coupling portions 47 arranged on the handle 35 may have a different length in the circumferential direction.

The hook 46 of the outer frame 14 and the hook coupling portion 47 of the handle 35 may protrude in parallel to each other in the radial direction. The hook 46 of the outer frame 14 may protrude radially inward from an inner circumferential surface of the outer frame 14, and the hook coupling portion 47 of the handle 35 may protrude radially outward from an outer circumferential surface of the handle 35.

The hook 46 of the outer frame 14 and the hook coupling portion 47 of the handle 35 may overlap with each other in a thickness direction of the handle 35, and be engaged with each other in the thickness direction when the outer frame 14 and the inner frame 19 are fastened to each other.

A hook protrusion may be provided at an end portion or end of the hook 46. The hook protrusion may protrude toward a side surface of the handle 35. A chamfer 461 may be inclined at a predetermined angle at one or a first edge or side of the hook protrusion. The contact portion 462 may be disposed substantially vertically at the other or a second side of the hook 46.

A chamfer 471 may be inclined at a predetermined angle at one or a first edge or side of the hook coupling portion 47 of the handle 35. A contact portion 472 may be disposed substantially vertically at the other or a second side of the hook coupling portion 47 of the handle 35.

According to this embodiment, when the outer frame 14 and the inner frame 19 are fastened to each other in a frontward-rearward direction (axial direction), the chamfers 461, 471 are in contact with each other, thereby facilitating the hook coupling portion 47 of the handle 35 to enter an inside of the hook 46 of the outer frame 14. In addition, subsequent to fastening the outer frame 14 and the handle 35, first and second contact portions 462, 472 of each of the hook 46 of the outer frame 14 and the hook coupling portion 47 of the handle 35 are in contact with each other substantially vertically, thereby preventing them from being released from each other.

An elastic groove 38 may be concave in the thickness direction on a rear surface of the flat portion 15 of the outer frame 14, and thus, the hook 46 may be elastically deformable radially outward by the elastic groove 38 when the hook 46 is inserted into and coupled to an inside of the hook coupling portion 47. Moreover, the hook coupling portion 36 may easily enter an inside of the hook 37 by the chamfers 461, 471. The hook 37 and the hook coupling portion 36 may be prevented from being released from each other by the contact portions 462, 472.

A reinforcing rib 45 may protrude toward the second adhesive overflow groove 442 at one side of the handle 35. The reinforcing rib 45 may be in contact with an opposite side of the second adhesive overflow groove 442. The reinforcing rib 45 of the handle 35 may compensate for a weakening of a strength of the flat portion 15 caused by a smaller thickness of the flat portion 15 due to the second adhesive overflow groove 442. In addition, the reinforcing rib 45 may serve as a spacer for maintaining a constant gap between the handle 35 and the flat portion 15, thereby reducing the thickness of the handle 35.

The reinforcing rib 45 may not only reinforce the strength of the handle 35 when the thickness of the handle 35 is reduced, but also maintain a contact state between the contact portion 462 of the hook 46 and the contact portion 472 of the hook coupling portion 47. Accordingly, coupling and assembly performance between the outer frame 14 and the inner frame 19 may be improved by a fastening structure between the hook 46 of the outer frame 14 and the hook coupling portion 47 of the handle 35.

Embodiments disclosed herein provide a laundry treating apparatus capable of easily providing a handle on a rear surface of the inner frame. Embodiments disclosed herein further provide a laundry treating apparatus capable of firmly maintaining a fastening state between the handle and the outer frame. Embodiments disclosed herein also provide a laundry treating apparatus capable of minimizing a thickness of the handle while maintaining a strength of the handle.

Embodiments disclosed herein provide a laundry treating apparatus that may include a main body having a front panel disposed with a laundry inlet port and a laundry accommodating portion that accommodates therein laundry loaded through the laundry inlet port; and a door rotatably provided on the front panel to open and close the laundry inlet port. The door may include an outer frame provided with an opening portion or opening, and disposed toward an outer side of the main body; a front glass attached to a front surface of the outer frame to cover the opening portion; an inner frame coupled to a rear surface of the outer frame, and disposed toward an inner side of the main body; a handle provided on a rear surface of the inner frame in a direction opposite to the front glass to pull the door with a user's hand while the door is closed; a hook that protrudes from an outer circumference of the outer frame to cover a side surface of the handle; and a hook coupling portion protruding from a side surface of the inner frame to engage with the hook. The hook and the hook coupling portion may be disposed to overlap with each other in a thickness direction of the handle on a side surface of the handle.

A first chamfer part or chamfer may be disposed to be inclined at one or a first edge or side of the hook, and a second chamfer part or chamfer may be disposed to be inclined at one edge of the hook coupling portion. The first chamber part and the second chamber part may be disposed in opposite directions to each other subsequent to fastening between the hook and the hook coupling portion.

A first contact portion may be disposed at the other or a second side of the hook, and a second contact portion may be disposed at the other or a second side of the hook coupling portion. The first contact portion and the second contact portion may be disposed to be in contact with each other while facing each other subsequent to fastening between the hook and the hook coupling portion.

Each of the outer frame and the inner frame may be defined in a circular ring shape. The hook may be defined in an arc shape along a circumferential direction of the outer frame. A plurality of the hook coupling portions may protrude on a side surface of the handle, and the plurality of hook coupling portions may be spaced apart along the arc shape of the hook.

The front panel may include a recess portion or recess disposed with the laundry inlet port thereinside, and disposed in a recessed manner toward an inside of the main body from the front panel, and a rear surface of the inner frame may be provided with a contact portion in contact with a portion where the depression of the recess portion starts when the door is closed. The contact portion may extend along a circumferential direction at an upper rear side of the inner frame with respect to a horizontal line passing through a center of the door in a radial direction.

The handle may be disposed in a recessed manner in a partial arc section along a circumferential direction on a rear surface of the inner frame. A hook protrusion may protrude from an end portion or end of the hook toward a side surface of the handle, and a first chamfer part or chamfer may be disposed to be inclined at one or a first edge of the hook protrusion, and a first contact portion may be disposed vertically on the other or a second side surface of the hook protrusion. The handle may be disposed at an inner side of the hook, and a depression depth of the handle may be defined between the first chamber part and the first contact portion.

The laundry treating apparatus may further include a reinforcing rib that protrudes from one surface of the handle to be in contact with a rear surface of the outer frame. A sum of thicknesses of each of the handle and the reinforcing rib may be less than a protruding length of the hook protruding from the outer frame.

The handle may be disposed at an upper rear side of the inner frame with respect to a horizontal line passing through the center of the door in a radial direction. The handle may be defined in a flat plate shape.

The handle may include a reinforcing rib that protrudes from the handle to be in contact with a rear surface of the outer frame. The reinforcing rib may minimize a size of the handle while reinforcing a strength of the handle.

A plurality of reinforcing ribs may protrude toward a rear surface of the outer frame from a front surface of the handle. Each of the plurality of reinforcing ribs may extend along a circumferential direction of the handle, and may be spaced apart in a radial direction of the handle.

The outer frame may include a flat portion having an adhesive groove that receives an adhesive for bonding the front glass and a plurality of adhesive overflow grooves that accommodate adhesive overflowing from the adhesive groove. The plurality of reinforcing ribs may be disposed to overlap with the plurality of adhesive overflow grooves in a thickness direction of the handle from the handle toward the outer frame.

A thickness of the hook coupling portion may be smaller than a lateral thickness of the handle. A thickness of the handle may decrease from a side surface of the handle toward an inner side in a radial direction of the inner frame.

The laundry treating apparatus may further include a handle pad attached to a rear surface of the handle. A sum of thicknesses of each of the reinforcing rib, the handle, and the handle pad may be disposed to correspond to a protruding length of the hook.

The handle according to embodiments disclosed herein may be recessed on a rear surface of an inner frame, and thus, the handle may be easily disposed on a rear surface of the inner frame. Further, the handle may be coupled to a rear surface of an outer frame together with the inner frame by a hook fastening structure, thereby facilitating fastening to the outer frame.

Furthermore, each of a hook of the outer frame and a hook coupling portion of the handle may have a wedge-shaped hook protrusion, and each hook protrusion may be defined such that an inclination of the second inclined surfaces in contact with each other subsequent to fastening the hook and the hook coupling portion is higher than that of the first inclined surfaces in contact with each other prior to fastening, thereby allowing the hook coupling portion to easily enter an inside of the hook while restricting the hook coupling portion from being separated from the hook.

An elastic groove may be disposed on a rear surface of the outer frame to guide the hook to be deformed radially outward after the hook of the outer frame and a second hook of the inner frame are fastened to each other, thereby allowing the second hook to easily enter an inside of the hook to improve assembly performance between the outer frame and the inner frame. A reinforcing rib may protrude to overlap with an adhesive groove in a thickness direction of the handle toward a rear surface of the outer frame, thereby reinforcing a strength of the outer frame that has been lowered due to the arrangement of adhesive grooves and adhesive overflow grooves for bonding the front glass to a front side of the outer frame.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body having a front panel with a laundry inlet port and configured to receive laundry loaded through the laundry inlet port; and a door rotatably coupled to the front panel to open and close the laundry inlet port, wherein the door comprises:

an outer frame provided with an opening and facing an outside of the main body;

a front glass coupled to a front surface of the outer frame to cover the opening;

an inner frame coupled to a rear surface of the outer frame and facing an inside of the main body;

a handle provided at a rear surface of the inner frame opposite to the front glass to receive a user's hand to pull the door while the door is closed;

a hook that protrudes from an outer circumference of the outer frame to cover a first side surface of the handle; and a hook coupling portion that protrudes from the first side surface of the handle to engage with the hook, wherein the handle comprises:

at least one reinforcing rib that protrudes from the handle to contact a rear surface of the outer frame.

2. The laundry treating apparatus of claim 1, wherein the handle is integrally formed with the outer frame.

3. The laundry treating apparatus of claim 1, wherein the hook and the hook coupling portion overlap each other in a thickness direction of the handle at the first side surface of the handle.

4. The laundry treating apparatus of claim 1, wherein a first chamfer is inclined at a first edge of the hook, wherein a second chamfer is inclined at a second edge of the hook coupling portion, and wherein the first chamfer and the second chamfer are disposed in opposite directions to each other subsequent to fastening between the hook and the hook coupling portion.

5. The laundry treating apparatus of claim 1, wherein a first contact portion is disposed at a first side of the hook, wherein a second contact portion is disposed at a first side of the hook coupling portion, and wherein the first contact portion and the second contact portion are configured to contact each other while facing each other subsequent to fastening between the hook and the hook coupling portion.

6. The laundry treating apparatus of claim 1, wherein each of the outer frame and the inner frame has a circular ring shape.

7. The laundry treating apparatus of claim 6, wherein the hook has an arc shape along a circumferential direction of the outer frame, wherein a plurality of the hook coupling portions protrudes at the first side surface of the handle, and wherein the plurality of hook coupling portions is spaced apart along the arc shape of the hook.

8. The laundry treating apparatus of claim 6, wherein the front panel comprises:

a recess recessed toward an inside of the main body from the front panel and having the laundry inlet port disposed thereinside, wherein a rear surface of the inner frame is provided with a contact portion in contact with a portion where a depression of the recess starts when the door is closed, and wherein the contact portion extends along a circumferential direction at an upper rear side of the inner frame with respect to a horizontal line that passes through a center of the door in a radial direction.

9. The laundry treating apparatus of claim 1, wherein a hook protrusion protrudes from an end portion of the hook toward the first side surface of the handle, wherein a first chamfer is inclined at an edge of a first side of the hook protrusion, wherein a first contact portion is disposed vertically on a surface of a second side of the hook protrusion, wherein the handle is disposed at an inner side of the hook, and wherein a depression depth of the handle is defined between the first chamfer and the first contact portion.

10. The laundry treating apparatus of claim 1, wherein the handle is disposed at an upper rear side of the inner frame with respect to a horizontal line that passes through a center of the door in a radial direction.

11. The laundry treating apparatus of claim 1, wherein the handle has a flat plate shape.

12. The laundry treating apparatus of claim 1, wherein the at least reinforcing rib comprises a plurality of reinforcing ribs, and wherein each of the plurality of reinforcing ribs extends along a circumferential direction of the handle and is spaced apart in a radial direction of the handle.

13. The laundry treating apparatus of claim 12, wherein the outer frame comprises:

a flat portion having an adhesive groove that receives an adhesive for bonding the front glass to the outer frame and a plurality of adhesive overflow grooves that accommodates the adhesive overflowing from the adhesive groove, and wherein the plurality of reinforcing ribs overlaps the plurality of adhesive overflow grooves in a thickness direction of the handle.

14. The laundry treating apparatus of claim 12, further comprising:

a handle pad attached to a rear surface of the handle.

15. The laundry treating apparatus of claim 14, wherein a sum of thicknesses of each of the plurality of reinforcing ribs, the handle, and the handle pad corresponds to a protruding length of the hook.

16. The laundry treating apparatus of claim 1, wherein a thickness of the hook coupling portion is smaller than a thickness of the handle.

17. The laundry treating apparatus of claim 1, wherein a thickness of the handle decreases from the first side surface of the handle toward an inner side in a radial direction of the inner frame.

18. A laundry treating apparatus, comprising:

a main body having a front panel with a laundry inlet port and configured to receive laundry loaded through the laundry inlet port; and a door rotatably coupled to the front panel to open and close the laundry inlet port, wherein the door comprises:

an outer frame provided with an opening and facing an outside of the main body;

a front glass coupled to a front surface of the outer frame to cover the opening;

an inner frame coupled to a rear surface of the outer frame and facing an inside of the main body;

a handle integrally formed with the inner frame at a rear surface of the inner frame to receive a user's hand to pull the door while the door is closed;

a hook that protrudes from an outer circumference of the outer frame; and a protrusion that protrudes from the handle to engage with the hook to couple the outer frame to the inner frame, wherein the handle comprises:

at least one reinforcing rib that protrudes from the handle to contact a rear surface of the outer frame.

19. The laundry treating apparatus of claim 18, wherein the hook and the protrusion overlap each other in a thickness direction of the handle.

20. The laundry treating apparatus of claim 18, wherein a first chamfer is inclined at a first edge of the hook, wherein a second chamfer is inclined at a first edge of the protrusion, and wherein the first chamfer and the second chamfer are disposed in opposite directions to each other subsequent to fastening between the hook and the protrusion.

21. The laundry treating apparatus of claim 18, wherein a first contact portion is disposed a first side of the hook, wherein a second contact portion is disposed at a first side of the protrusion, and wherein the first contact portion and the second contact portion are configured to contact each other while facing each other subsequent to fastening between the hook and the protrusion.

22. The laundry treating apparatus of claim 18, wherein the handle is recessed in a partial arc section along a circumferential direction on an upper portion of the rear surface of the inner frame.

23. The laundry treating apparatus of claim 18, further comprising:

a handle pad attached to a rear surface of the handle.

24. A laundry treating apparatus, comprising:

a main body having a front panel with a laundry inlet port and configured to receive laundry loaded through the laundry inlet port; and a door rotatably coupled to the front panel to open and close the laundry inlet port, wherein the door comprises:

an outer frame provided with an opening and facing an outside of the main body;

a front glass coupled to a front surface of the outer frame to cover the opening;

an inner frame coupled to a rear surface of the outer frame and facing an inside of the main body;

a handle in the form of a recess provided at a rear surface of the inner frame to receive a user's hand to pull the door while the door is closed;

a hook that protrudes from an outer circumference of the outer frame; and a protrusion that protrudes from the handle to engage with the hook to couple the outer frame to the inner frame at a location corresponding to the handle, wherein the handle comprises:

at least one reinforcing rib that protrudes from the handle to contact a rear surface of the outer frame.

25. The laundry treating apparatus of claim 24, wherein the handle is integrally formed with the outer frame.

26. The laundry treating apparatus of claim 24, wherein the handle is recessed in a partial arc section along a circumferential direction on an upper portion of the rear surface of the inner frame.

27. The laundry treating apparatus of claim 24, further comprising:

a handle pad attached to a rear surface of the handle.

28. A laundry treating apparatus, comprising:

a main body having a front panel with a laundry inlet port and configured to receive laundry loaded through the laundry inlet port; and a door rotatably coupled to the front panel to open and close the laundry inlet port, wherein the door comprises:

an outer frame provided with an opening and facing an outside of the main body;

a front glass coupled to a front surface of the outer frame to cover the opening;

an inner frame coupled to a rear surface of the outer frame and facing an inside of the main body;

a handle provided at a rear surface of the inner frame opposite to the front glass to receive a user's hand to pull the door while the door is closed;

a hook that protrudes from an outer circumference of the outer frame to cover a first side surface of the handle;

a hook coupling portion that protrudes from the first side surface of the handle to engage with the hook, wherein the handle is recessed in a partial arc section along a circumferential direction on the rear surface of the inner frame; and at least one reinforcing rib that protrudes from a second side surface of the handle to contact a rear surface of the outer frame, wherein a sum of thicknesses of each of the handle and the at least one reinforcing rib is less than a protruding length of the hook protruding from the outer frame.

* * * * *